US011617699B1

(12) United States Patent
Jahangiri

(10) Patent No.: US 11,617,699 B1
(45) Date of Patent: Apr. 4, 2023

(54) POSTURE ENHANCING DEVICE

(71) Applicant: Parviz Jahangiri, Portland, OR (US)

(72) Inventor: Parviz Jahangiri, Portland, OR (US)

(73) Assignee: Contoureal, LLC, Portland, OR (US)

( * ) Notice: Subject to any disclaimer, the term of this patent is extended or adjusted under 35 U.S.C. 154(b) by 515 days.

(21) Appl. No.: 16/405,039

(22) Filed: May 7, 2019

Related U.S. Application Data

(60) Provisional application No. 62/715,670, filed on Aug. 7, 2018.

(51) Int. Cl.
*A61H 1/02* (2006.01)

(52) U.S. Cl.
CPC ..... *A61H 1/0222* (2013.01); *A61H 2201/163* (2013.01); *A61H 2201/1642* (2013.01); *A61H 2203/0456* (2013.01)

(58) Field of Classification Search
CPC .. A61H 1/0218; A61H 1/0222; A61H 1/0292; A61H 1/0296; A61H 2201/0138–0149; A61H 2201/0192; A61H 2201/1604; A61H 2201/1607; A61H 2201/1609; A61H 2201/1623; A61H 2201/1626; A61H 2201/1628; A61H 2201/163; A61H 2201/164; A61H 2201/1642; A61H 2203/0443–0475; A61H 2205/04; A61H 2205/081; A61H 2205/088; A61F 5/30; A61F 5/32; A61F 5/34
See application file for complete search history.

(56) References Cited

U.S. PATENT DOCUMENTS 2,283,549 A * 5/1942 Galbraith ..... A61H 1/0222 5/613
2,534,587 A * 12/1950 Fisher ..... A61H 15/0078 601/102
2,630,800 A * 3/1953 Voss ..... A61H 1/0222 606/244
5,613,254 A * 3/1997 Clayman ..... A61G 13/0054 5/613
2003/0144613 A1* 7/2003 Kitada ..... A61H 1/0218 601/24
2005/0222523 A1* 10/2005 Splane ..... A61H 1/001 601/24
2007/0093367 A1* 4/2007 Walton ..... A61H 7/001 482/142

(Continued)

*Primary Examiner* — Valerie L Woodward
(74) *Attorney, Agent, or Firm* — Baumgartner Patent Law; Marc Baumgartner

(57) ABSTRACT

A device that allows the user to provide spinal traction and splay in a localized and fully controllable way that has the device auto-return to a neutral position in case the user inadvertently loses control of operating the device, that has the ability to induce corrective spinal curvature from the lordotic neck curvature to the sacral curvature, that has the ability to conform or adjust to the varying curvature of differing body builds, that has the ability to provide corrective curvatures to all sides of a human body (front, side, back, and any hybridized orientation), that is adjustable for ergonomics to stretch or to compress any sections of the spinal curvature in a localized manner, that allows the benefits of splaying forces to correct spinal curvature, and that allows axial adjustment to the spinuous process.

25 Claims, 13 Drawing Sheets

(56) References Cited

U.S. PATENT DOCUMENTS

2007/0293796 A1* 12/2007 Graham ..... A61H 1/0292
602/19
2011/0137343 A1* 6/2011 Vitko ..... A61H 1/0222
606/240

* cited by examiner

ContouReal™ Posture Curve

ContouReal™ Copyright 2018

ContouReal™ Copyright 2018

ContouReal™ Copyright 2018

ContouReal™ Copyright 2018

Adjustable Device with Vertebrae aligner and Posture Enhancer, Front and Back

ContouReal™ Copyright 2018

ContouReal™ Copyright 2018

Adjustable Posture Enhancing Chair
in relation to body.

ContouReal™ Copyright 2018

ContouReal™ Copyright 2018

ContouReal™ Copyright 2018

POSTURE ENHANCING DEVICE

CROSS REFERENCE TO RELATED APPLICATIONS

This Non Provisional Application is a continuation of, and carries the benefits of the earlier filing of, Provisional Applications 62/668,387 and 62/715,670 filed on May 8, 2018, and Aug. 7, 2018, respectively.

The following is a tabulation of some prior art that presently appears relevant:

| U.S. Pats. | | | |
|---|---|---|---|
| Pat. No. | Kind Code | Issue Date | Patentee |
| U.S. 4,230,099 | | Oct. 28, 1980 | Richardson |
| U.S. 5,279,310 | | Jan. 18, 1994 | Hsien |
| U.S. 5,774,916 | | Jul. 7, 1998 | Kurhi |
| Non Patent Literature Documents | | | |
| Plexus Wheel: www.gochirp.com | | | |

BACKGROUND—PRIOR ART FOR POSTURE ENHANCING DEVICE

Back problems have been the bane of human condition in recorded history. One of the chief contributors is when the body, along with its internal supports, is misaligned under physical stress. This stress can even come from the body simply supporting itself under normal conditions such as upright sitting. Adding to this stress is a shifting of life styles that has us in a more sedentary type, a type where people are often find themselves in poor ergonomic conditions under prolonged periods. This often stems from spending inordinate time indoor in front of a computer, peering over their smart phones, or simply watching TV from a couch.

On a more aggravated level, any of our sports involve physical contact, or sudden maneuvers, that can cause systemic and also catastrophic injuries to the athlete. One of the most common but under-addressed injury is to the neck and its surrounding region. And one of the chief causes for this type of injury happens when a person's body comes to a sudden stop, causing the still-moving head to rely on neck resistance to bring it to full but later rest. This type of injury is aggravated further when two bodies collide. Another more common form is helmeted sports such as Football, where impact to the helmeted head causes tremendous neck stress and unnatural displacement/orientation. This form of injury has recently become very public when the National Football League (NFL) had to settle with retired NFL players suffering from this form of injury as well as brain related mental health issues. Sports have become big money, and in doing so, it has up the ante on the intensity of the sport as well as the consequential injury.

One of the most visible solutions to neck injuries and head trauma is to strengthen the neck using resistance based exercises in conjunction with their corresponding devices. Although these exercises work the neck, they fail to exercise the neck and its nearby body regions in the position on impact. This impact orientation is important because it orients and displaces the vertebrae, muscles, tendons, ligaments in its most vulnerable position.

There are two common forms of exercises; isotonic and isometric muscle contraction. The difference between these two contractions is while isometric maintains a joint angle while increasing the work load to the muscle, isotonic has both a joint angle change and a concentric (shortening) and eccentric (lengthening) motion of that muscle. An example of isometric is to hold a cup while pouring water into it. An example of isotonic is the flexing and relaxing of the bicep muscle.

The most optimal strengthening device has the ability to concurrently offer both isotonic and isometric forms of strengthening. This is especially true in the head impact scenario where the head is relatively stationary on impact. It is in this scenario that the impact puts a tremendous stress to the neck when resisting the impact energy that is now displacing this head from its pre-impact position. The goal in this case is to minimize this displacement so as to minimize the injury. Therefore, isometric strengthening of the neck with the head in an impact position strengthens the necessary organs and muscles necessary to resist this displacement.

It is also beneficial to combine isotonic strengthening to isometric strengthening. A football tackle injury is often the result of both isotonic and isometric muscle contraction, with the stationary head in impact position as isometric compression, and the arms closing in on the tackle as the isotonic movement. Therefore strengthening can be maximized having the head strengthening in isometric compression, while the arms are outstretched in an isotonic strengthening motion.

As result of the above, there is an increase in urgency to rehabilitate as well as prevent these injuries.

A common first common approach is to release the body from soft tissue stresses accrued when the soft tissue, namely muscles, are required to compensate from the body working under un-ergonomic conditions.

A common subsequent approach is the realignment of the structural supports within the body so that the compensations are minimize or eliminated. Chiropractic Body Adjustments is widely used as a form of treatment along this line.

And a common final approach is to then strengthen the correctly aligned structural supports, such as core strengthening, so that the body has structural supports ergonomically intact when it operates under stress. This then prevents any soft tissue compensations.

The best approach to accomplishing these rehabilitative steps is to treat the whole body holistically. This holistic approach has the highest efficacy as it addresses the causes at the root level rather than the symptoms that often manifest remote and distant from the causes. Our bodies are complex in the soft tissue connections that often refers pain—and the subsequent soft tissue responses to that pain- to remote places counter-intuitive to the untrained person.

Currently, there is a dearth of devices that provide these rehabilitative steps in a holistic manner.

Additionally, the gregarious nature of our society that has them traveling often requires rehabilitation beyond the offices of professionals and beyond the confines of home. People who travel seek portability and flexibility for this form of rehabilitation that can be self administered. As a result, rehabilitative devices that can be used at home or during road trips in hotels have become more and more main stream. This rehabilitative regiment, no matter the place, convenience of time, or comfort of a chiropractic office, has become a very important factor in today's highly nomadic lifestyle. Therefore, the flexibility of a rehabilitative device that is portable for road travels, as well as a home based device, is highly desirable to the serious athlete.

Additionally, the rehabilitative device must be capable to adjust to the differing body ergonomics of the user. This adjustability feature is not only for ergonomic reasons, but also allows the user to tailor the settings to push his or her rehabilitation to the extreme. One such adjustment is to support the undulations of the spine that offers isometric tensioning, allowing the user an extreme range of rehabilitation to match their pain threshold.

Aside from the adjustability considerations above, the rehabilitative device must be safe for usage, allowing the user to be in full control in applying forces especially to the back area. This full control feature is so that in the event the user loses control of the operations of such device, or suffers lapses of concentration, the device is able to return to a neutral position that removes any possibility of injury. This is even more important with the spinal vertebrae once injured can often become irreparably damaged that often leads to permanent immobility.

Another benefit to consider is the device has the ability to provide axial compressive load the vertebrae. This axial load can be critical in stimulating bone growth (strength) in the inner bone cortices. This growth points to Wolff s Law, a bone strengthening model developed by German anatomist and surgeon Julius Wolff, that states that bone in a healthy person or animal will adapt to the load under which it is placed. It also states that if loading on a bone is increased, the bone will remodel itself over time to become stronger to resist that load.

Another ailment common to both sports and non sports participants is the loss of cervical lordotic curve. This loss is a major contributor to neck pain and tension. A loss of the normal curve, or reversal of such curve, is also responsible for an increase in the speed of deterioration and arthritis of the spine. The resultant injury from a helmet-to-helmet collision is reduced when the lordosis/curve acts like a spring to absorb the forces produced from such collision. As a result, concussion and brain injury are also reduced. Without the energy absorbing properties from a proper lordotic curve, stress from such collision is then deferred to the vertebral bodies, brain, and inter-vertebral discs to absorb the force, causing severe injury. Additionally, a proper lordotic curve shortens the lever arm that has the head impact on one end, and the connection to the upper thoracic spine on the other end. This shorter lever arm decreases whiplash injury and brain injury in all contact sport collisions. There is currently a dearth of rehabilitative devices that can restore or induce normal lordotic curvature as well as restore other curvatures in the spinal column simultaneously.

In reference to a FIG. 1 embodiment as shown in U.S. Pat. No. 4,230,099 issued on Oct. 28, 1980 issue to Richardson, this Thomas embodiment does not meet the challenges of restoring the spinal area holistically (it only addresses specific curvatures), of posture enhancement (rather it only address alignment), of the need for adjustability (it is fixed in nature), of rehabilitating the frontal side of the body (it only addresses the back), of the need to remediate based on Transition Points.

In reference to FIG. 5, Transition Points are points along the spinal column where spinal vertebrates changes in lining up from a concave shape to a convex shape. This transition point largely coincides with a vertical line (Vertical Axis), drawn between the top vertebrate to the tail bone, and a central line (Central Axis) that connects to the central axis of each vertebrate. They are should ideally be supported or controlled so that they relatively align in a straight line. Transitions Points coincide with traverse features on the body such as the nose, the sternomanubrial joint, the xiphisternal joint, the navel, and the hip joints respectively In reference to the above FIG. 2 embodiment as shown in U.S. Pat. No. 5,279,310, issued on Jan. 18, 1994 Hsien, this Hsien embodiment is not adjustable, it does not have frontal support, it does not address Transitions Points, it is not suitable for posture enhancement, the head rest shape and offset to the rest of the body causes the posture to be misaligned, and it does not induce a suitable lordotic curvature.

In reference to the above FIG. 3 embodiment as shown in U.S. Pat. No. 5,774,916 issued on Jul. 7, 1998 to Kurhi, this Kurhi embodiment is not adjustable, it does not allow splaying forces as part of the corrective and pain relief process, it does not have frontal support, it does not address Transitions Points, it is not suitable for posture enhancement, the head rest shape and offset to the rest of the body causes the posture to be misaligned, and it does not induce a suitable lordotic curvature.

In reference to the above FIG. 4 embodiment, a commercially available solution called Plexus Wheel, this device suffers from the inability have frontal support, it does not address Transitions Points, and it is not suitable for posture enhancement.

ADVANTAGES

Accordingly, several advantages of one or more aspects are as follows: to have a exercise device that is inexpensive to produce, to have such device that is portable for convenient transporting and is wide use for differing environments, that allows the user to provide spinal traction and splay in a localized and fully controllable way that has the device auto-return to a neutral position in case the user inadvertently loses control of operating the device, that has the ability to induce corrective spinal curvature from the lordotic neck curvature to the sacral curvature, that has the ability to conform or adjust to the varying curvature of differing body builds, that has the ability to provide corrective curvatures to all sides of a human body (front, side, back, and any hybridized orientation), that is adjustable for ergonomics to stretch or to compress any sections of the spinal curvature in a localized manner, that allows the benefits of splaying forces to correct spinal curvature, and that is portable, that allows axial adjustment to the spinuous process.

DRAWINGS—FIGURES

Notice: A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

ALTERNATE EMBODIMENTS

Figure 7:
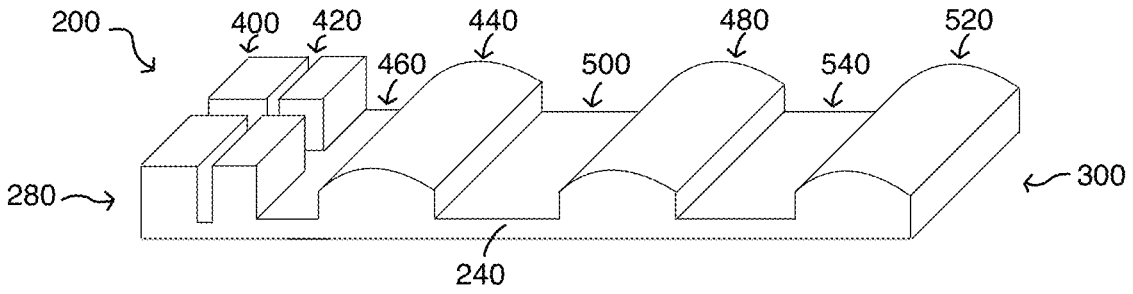
Figure 9:
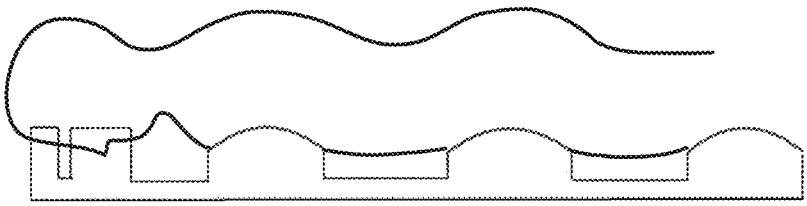
Figure 8:
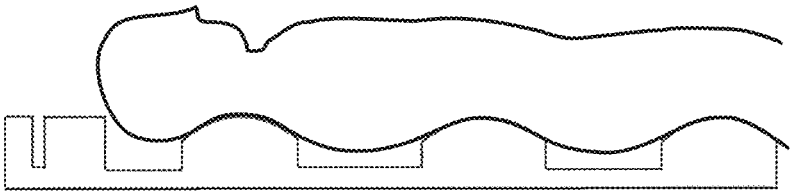
Figure 10:
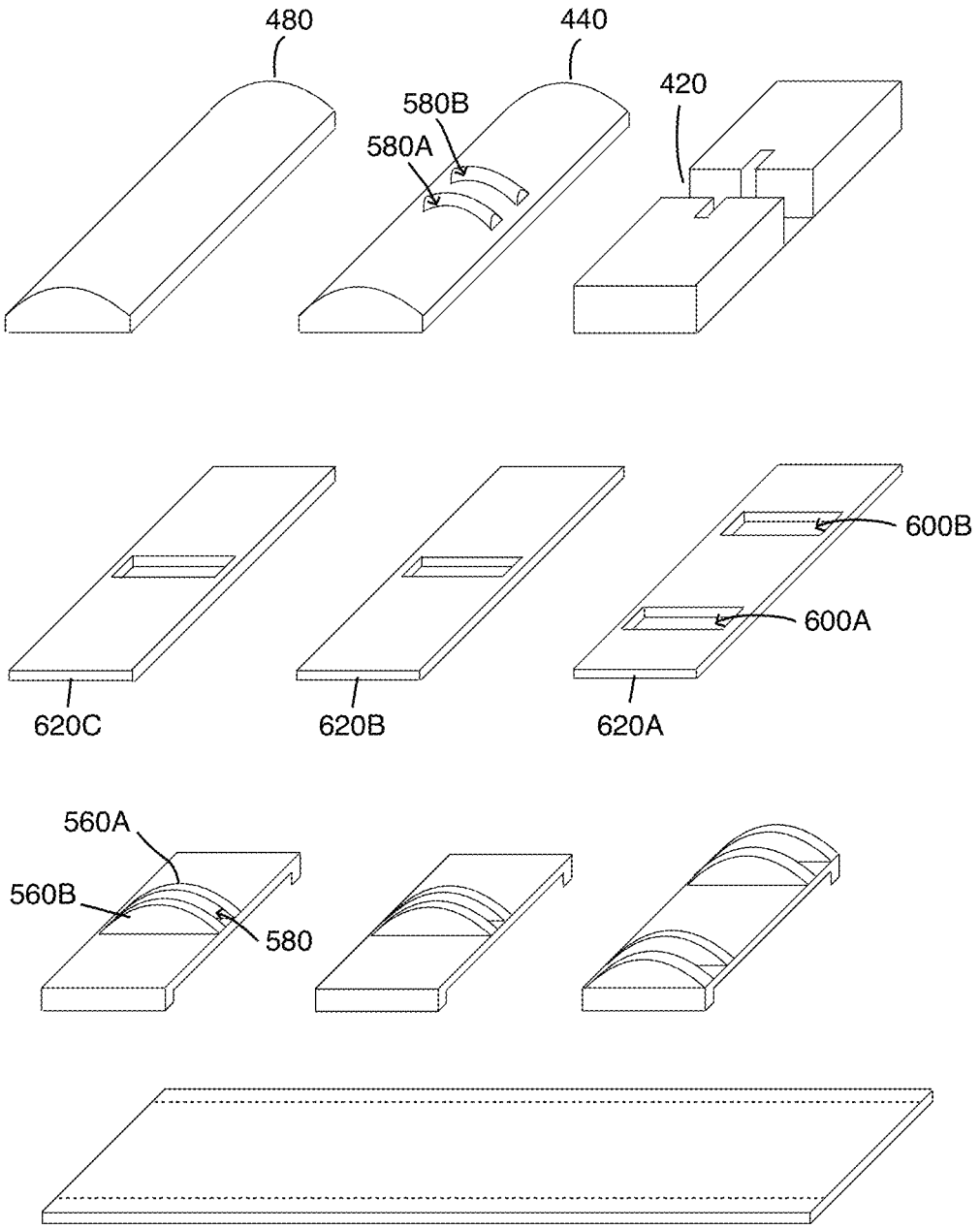
Figure 11:
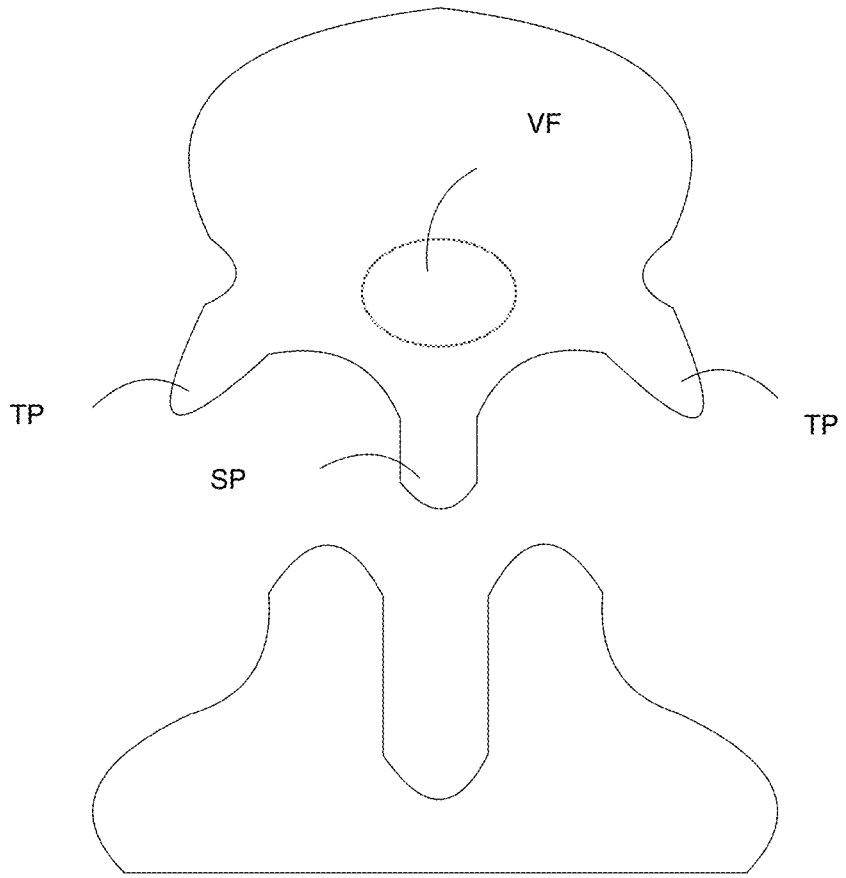
Figure 12:
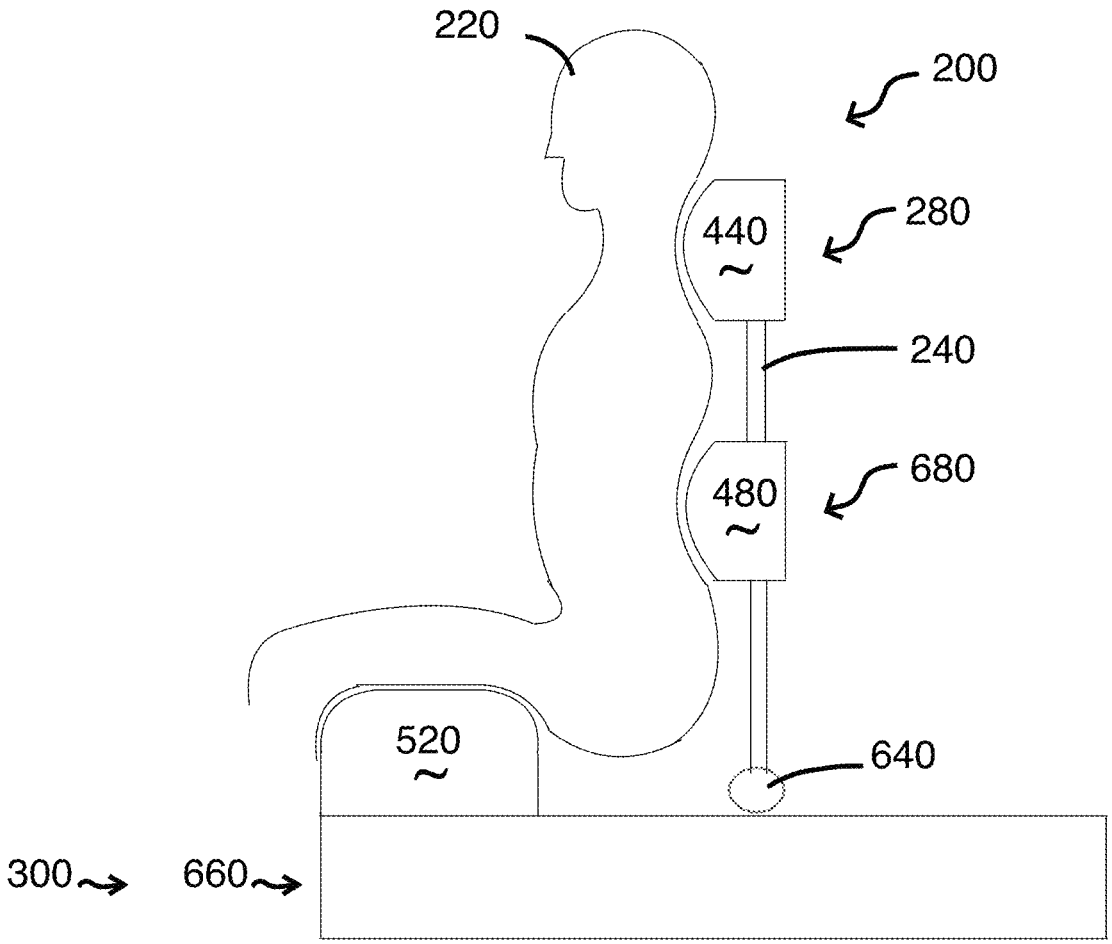
Figure 13A:
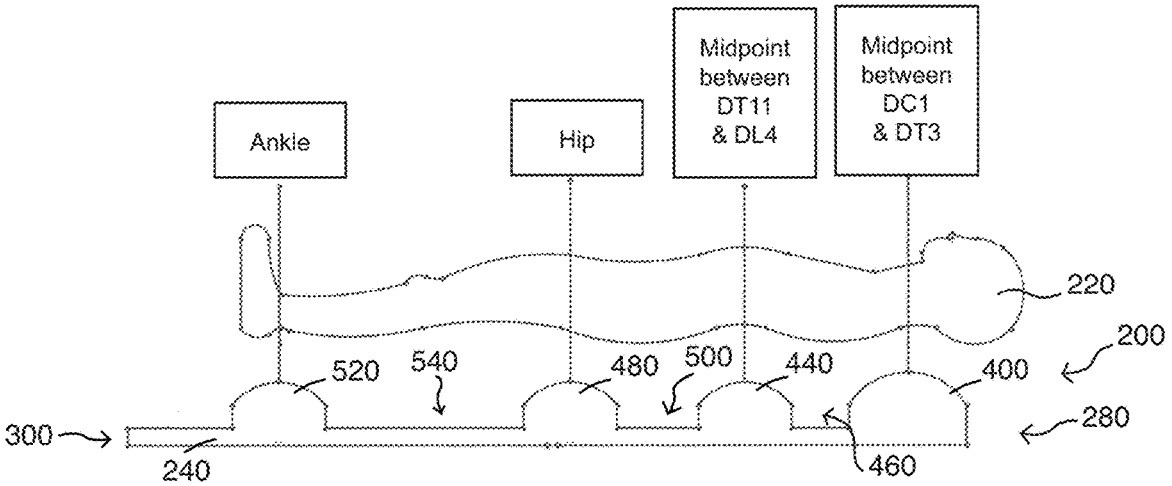
Figure 13B:
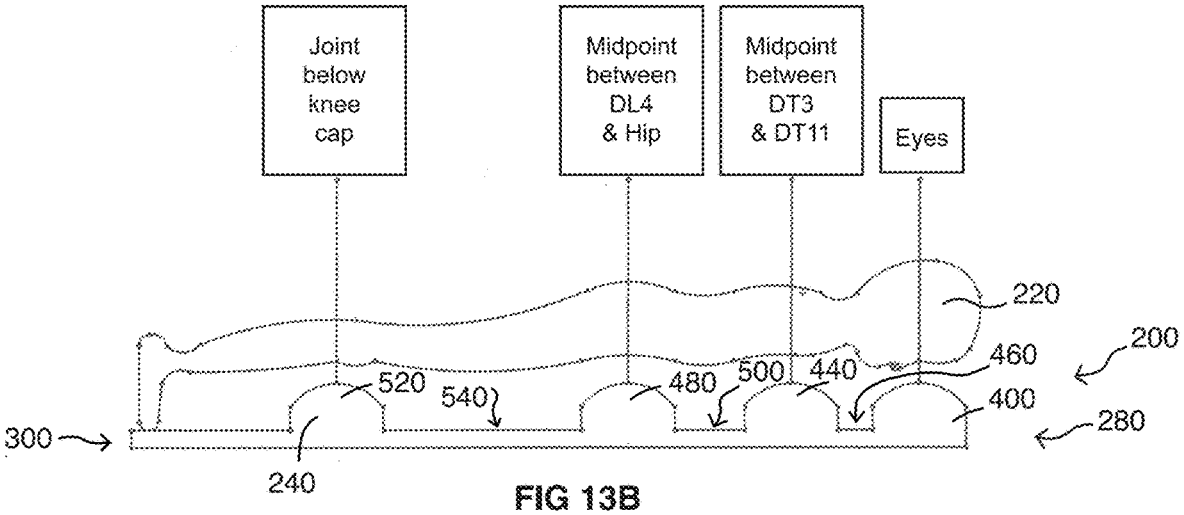
Figure 15:
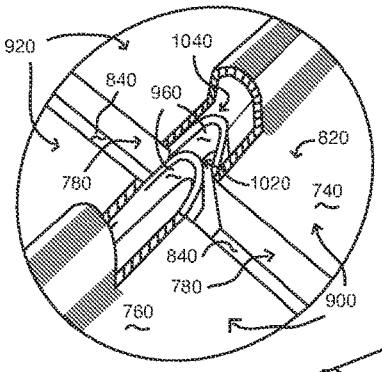
Figure 14:
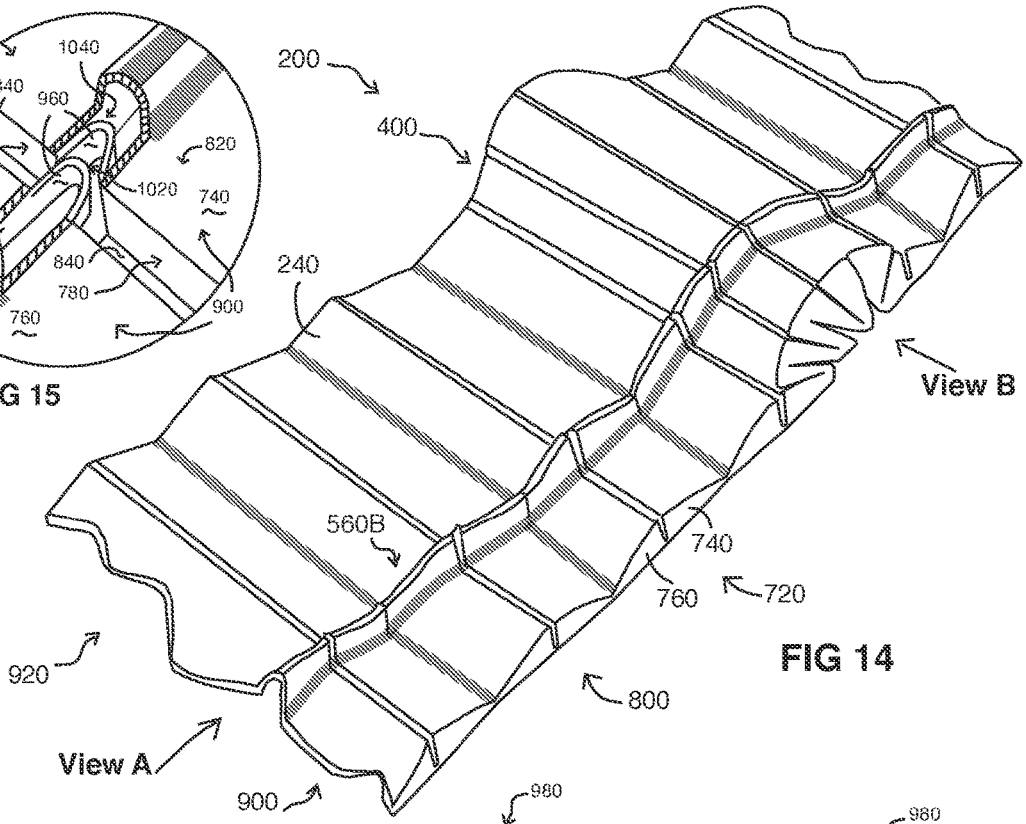
Figure 17:
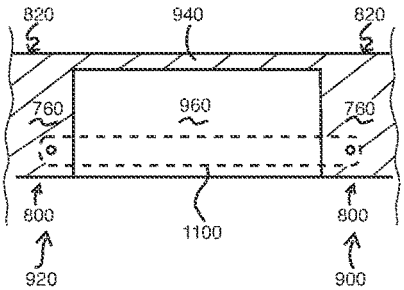
Figure 18:
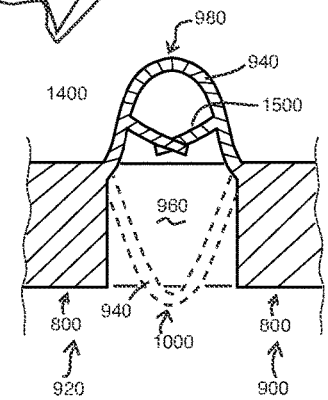
Figure 19:
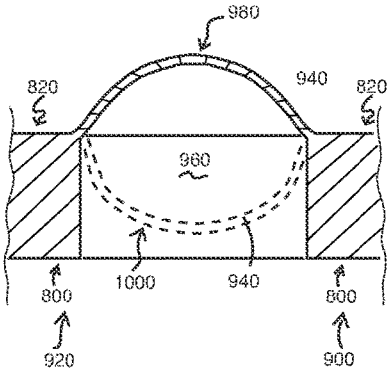
Figure 20:
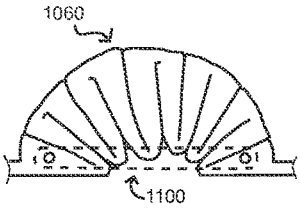
Figure 21:
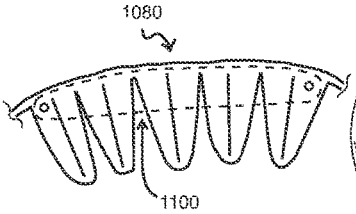
Figure 16:
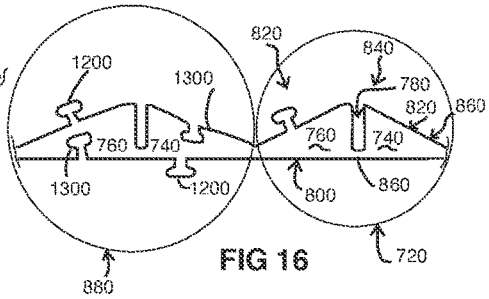

FIG. 7 illustrates a perspective view of a First Alternative;

FIG. 8 illustrates a side view of a First Alternative Embodiment when used in a supine position;

FIG. 9 illustrates a perspective view of the Posture Enhancing Device in a First Alternative Embodiment when used in a face down position;

FIG. 10 illustrates a perspective view of the Posture Enhancing Device in a Second Alternative Embodiment;

FIG. 11 illustrates a perspective view of the Posture Enhancing Device in a Second Alternative Embodiment engaging with the Spinous process;

FIG. 12 illustrates a perspective view of the Posture Enhancing Device in a Third Alternative Embodiment;

FIG. 13 illustrates a perspective view of the Posture Enhancing Device in a Fourth Alternative Embodiment (A—supine position, B—frontal position);

FIG. 14 illustrates a perspective view of the Posture Enhancing Device in a Fifth Alternative Embodiment;

FIG. 15 illustrates a close up view of the First and Second Segment of the First Group in a Fifth Alternative Embodiment;

FIG. 16 illustrates a side view of the First and Second Segment of both the First and Second Group in a Fifth Alternative Embodiment;

FIG. 17 illustrates a View A end view of the Device in a Fifth Alternative Embodiment;

FIG. 18 illustrates a View A end view of the Device in a Fifth Alternative Embodiment, with a sharp radius raised ridge;

FIG. 19 illustrates a View A end view of the Device in a Fifth Alternative Embodiment, with a soft radius raised ridge;

FIG. 20 illustrates side view B of a tight configuration in a Fifth Alternative Embodiment;

FIG. 21 illustrates side view B of a loose configuration in a Fifth Alternative Embodiment;

DRAWINGS—REFERENCE NUMERALS

| | |
|---|---|
| 200 | Posture Device |
| 220 | Operator |
| 240 | Base unit |
| 260 | A&B Guides |
| 280 | Top end |
| 300 | Bottom End |
| 320 | Neck Support Unit |
| 340 | Mid back Support Unit |
| 360 | Pelvic Support Unit |
| 380 | Top Surface |
| 400 | First Support End |
| 420 | First Depression |
| 440 | Second Support End |
| 460 | Second Depression |
| 480 | Third Support End |
| 500 | Third Depression |
| 520 | Fourth Support End |
| 540 | Fourth Depression |
| 560 | A&B Raised Ridge |
| 580 | Fifth Depression |
| 600A&B | Cutouts |
| 600A,B&C | Leveling Inserts |
| 640 | Locking Hinge |
| 660 | Lower Portion |
| 680 | Upper Portion |
| 700 | Fifth support |
| 720 | First Group |
| 740 | First Segment |
| 760 | Second Segment |
| 780 | Vertical side |
| 800 | Bottom side |
| 820 | Slope side |
| 840 | High End |
| 860 | Low End |
| 860 | First Flexible Membrane End |

-continued

| | |
|---|---|
| 880 | Second Group |
| 900 | First Portion |
| 920 | Second Portion |
| 940 | Second Flexible Membrane End |
| 960 | Third Flexible Membrane End |
| 980 | Upward Bend |
| 1000 | Downward Bend |
| 1020 | Away from Segment |
| 1040 | Into Segment |
| 1060 | Tight Configuration |
| 1080 | Loose configuration |
| 1100 | Adjustable strap |
| 1200 | Male Interlock |
| 1300 | Female Interlock |
| 1400 | Male Strap |
| 1500 | Female strap |

SUMMARY: EMBODIMENTS

Embodiments of the approaches described herein provide a device comprising of a base unit to be used in conjunction with a human body, the base unit having a first end and a second end, the device further comprising of at least a first support end and at least a first support unit; the at least first support end located at the first end, the at least first support unit slidably and lockably located longitudinally on the base unit away from the at least first support end to form a first intermediary gap, the at least first support unit comprising of a contoured side to largely receive and support the curvature of the human body.

Optionally, the device further comprising an at least second support unit, and an at least third support unit; the at least second support unit slidably and lockably located longitudinally on the base unit away from the at least first support unit to form a second intermediary gap, and the at least third support unit slidably and lockably located longitudinally on the base unit located away from the at least second support unit to form a third intermediary gap.

Optionally, the first support end is contoured to largely receive and support the cervical area of a human spine, the first support unit is contoured to largely receive and support the lumbar area of said spine, the second support unit is contoured to largely receive and support the pelvis area of said spine, and the third support end is contoured to largely receive and support the ankle area.

Optionally, the first, second, and third support units comprise of a first transition point surface, a second transition point surface, and a third transition point surface respectively, wherein these transition point surfaces project from the base in a manner where they can be substantially connected to each other in a straight line; wherein the human spine comprising of a first, of a second, and of a third transition point that correspond to the location on the spine where the spine inverts from a concave to a convex curvature in the sequence from the cervical and ending at the sacrum area; whereby the first support unit, the second support unit, and the third support unit can be adjusted so that the first, second, and third transition points are supported in a manner that substantially aligns them in a straight line.

Optionally, the first support end further comprising a first recess and a second recess, the first recess end running longitudinally substantially down the middle of the first support unit, the second recess running traverse to the first recess; whereby both first and second recess are substantially located on the first support unit to provide relief for the human eyes, nose, and mouth.

Optionally, the contoured side of the at least first support unit optionally comprises of a first ridge support end and a second ridge support end that both project normally from the contoured side, the first ridge support end and the second ridge support end are positioned apart from each other at a distance no wider than the normal thickness of a spinous process of a human spine but less than the normal width of the spine, the longitudinally length of the first ridge support end and of the second ridge support end run substantially parallel to the longitudinal length of the base unit.

Optionally, the device optionally comprising of a first insert assembly, the first insert assembly comprising of a first ridge support and a second ridge support coupled to each other, the contoured side optionally comprising of a first aperture and a second aperture, the first insert assembly slidably engaging with the at least first support unit in a selectable manner with the first ridge support passing through the first aperture and the second ridge support passing through the second aperture, whereby the amount of the first ridge support end and the second ridge support end protruding beyond the contoured side is adjustable in a locking manner.

Optionally, the device of claim 7 wherein the amount of the first ridge support end and the second ridge support end protruding beyond the contoured side optionally comprises of a predetermined height shim intermediary between the at least first support unit and the first insert assembly.

Optionally, a base unit to be used in conjunction with a human body, comprising of a plurality of support ends, the plurality of support ends comprising of an at least a first support end; the at least first support end located longitudinally along the base unit, the at least first support end comprising of a contoured side to largely receive and support the curvature of the human body, the base unit is segmented into a plurality of mirror identical units coupled to each other in a flexibly connecting manner, the plurality of mirror identical units comprising of at least a first unit and a second unit, the first unit comprising of a first segment and a second segment, the first segment comprising of a high end and a low end, the second segment is identical to the first segment but oriented in a mirror opposite manner to the first segment, the first segment and the second segment are flexibly coupled to each other at each other's high ends, the second unit is identical to the first unit, the low end of the first segment of the second unit is flexibly coupled to the low end of the second segment of the first unit; whereby the base unit can be configured so that the first support end can be variably located along the longitudinal length of the base unit, whereby the protrusion height and the radius of the first support end are both variably and adjustable in a selectable manner.

Optionally, the base unit further comprising of a first portion and a second portion, the second portion being mirror identical to the first portion, the first segment comprising of a slope side and a vertical side, the first segment of the first portion is flexibly coupled to the first segment of the second portion at both their slope sides by a first couple, the first segment of the first portion flexibly coupled to the first segment of the second portion at both their vertical sides by a second couple; wherein the device further comprising a third ridge support comprising of the first couple and the second couple in the proximity of the at least first support end; whereby the proximity distance between the first portion and the second portion is selectably adjusted so that the first couple and the second couple buckle in a varying and locking manner, whereby the height of the third ridge support running substantially longitudinal along both the first support end and the base unit can be varied by the proximity distance.

Optionally, the base unit further comprising a third portion, the third portion being mirror identical to the second portion, the first segment comprising of a slope side and a vertical side, the first segment of the second portion is flexibly coupled to the first segment of the third portion at both their slope sides by a third couple, the first segment of the second portion flexibly coupled to the first segment of the third portion at both their vertical sides by a fourth couple; wherein the device further comprising a fourth ridge support comprising of the third couple and the fourth couple in the proximity of the at least first support end; whereby the proximity distance between the second portion and the third portion is selectably adjusted so that the third couple and the fourth couple buckle in a varying and locking manner, whereby the height of the fourth ridge support running substantially longitudinal along both the first support end and the base unit can be varied by the proximity distance between the second portion and third portion.

Optionally, the first couple between the first and second portion further comprise of a first leg and a second leg projecting substantially normal to the first couple, the first leg and the second leg selectively and adjustably lock to each other in a locking manner, whereby the proximity distance between the first and the second portion is varied in an selectably locking manner.

Optionally, the base unit further comprising a first adjustable strap having a first end and a second end, the first end is lockably attached to the first portion, the second end is lockably attached to the second portion, wherein the proximity distance between the first and second portion is adjusted in a locking manner by changing the length of the first adjustable strap.

Optionally, the plurality of units further comprising of an at least third unit and a second adjustable strap, the third unit is identical to the second unit, the low side of the first segment of the third unit is flexibly connected to the low side of the second segment of the second unit by a fifth couple, the second adjustable strap having a first end and a second end, the first end is lockably attached to the at least first unit, the second end is lockably attached to the at least third unit located longitudinally away from the at least first unit, wherein the proximity distance between the at least first unit and the at least third unit is adjustable in a locking manner by changing the length of the second adjustable strap, wherein the first support end is configured to comprise of the at least first unit and the at least third unit; whereby the radius and height of the first support end is adjustable in a removably locking manner by adjusting the length of the second adjustable strap.

Optionally, the second adjustable strap comprises of an oscillating device that lengthens and shortens the proximity distance between first unit and the third unit in an oscillating manner.

Optionally, the first adjustable strap comprises of an oscillating device that lengthens and shortens the proximity between the first portion and the second portion in an oscillating manner.

Optionally, a base unit to be used in conjunction with a human body, comprising of a plurality of support ends, the plurality of support ends comprising of an at least a first support end; the at least first support end located longitudinally along the base unit, the at least first support end comprising a contoured side to largely receive and support the curvature of the human body, the base unit is further segmented into a first longitudinal portion and a second longitudinal portion that are pivotally connected to each other in an adjustably locking manner between the angles of 60 to 180 degrees, the first longitudinal portion further comprising of an at least a second support unit located longitudinally away from the at least first support end in an adjustable and locking manner to form a first intermediary gap, the second longitudinal portion further comprising of an at least third support unit; whereby the device can be optionally used as a stand-alone chair or in conjunction with a furniture such as a chair by means of securing device to the furniture with locking loop straps.

Figure 6:
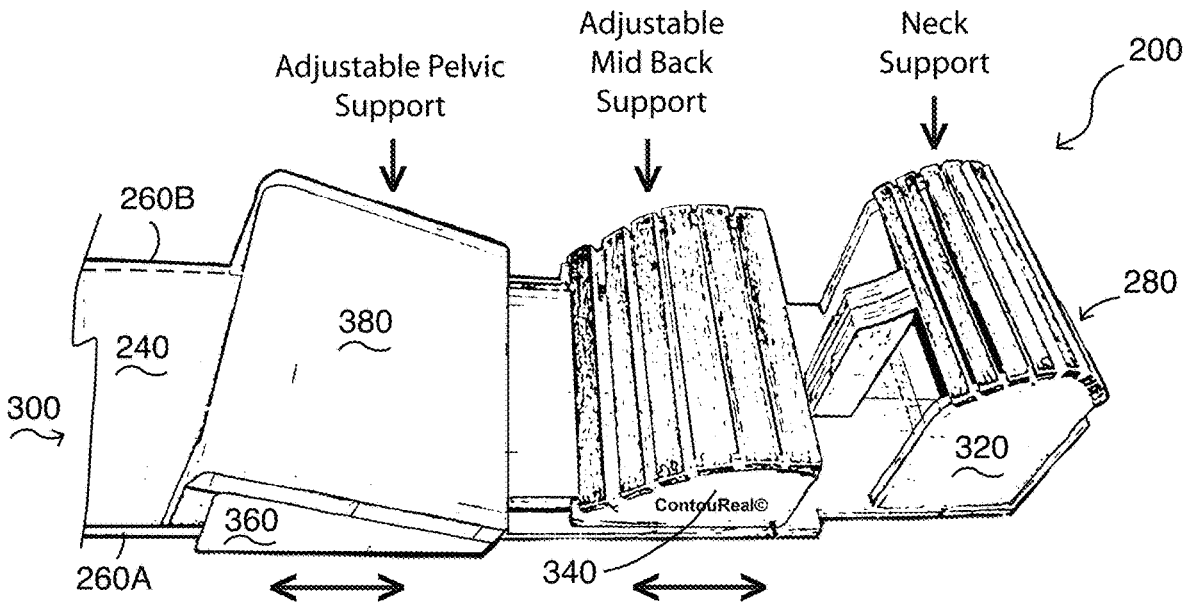
FIG. 6 illustrates a perspective view of the Posture Enhancing Device of the present invention and an operator.

Detailed Description of Main Embodiment, FIG. 6

This Left Side teaching is repeated for the Right Side of the figures, and vice versa, as the embodiment is symmetrically identical on both sides where applicable, with the part callout having an 'A' part name for the Left side and 'B" part name for the Right Side for teaching purposes. Whenever there is no subpart name, it is assumed the right side for left side teaching and vice versa is still preserved.

While the configurations according to the illustrated embodiment are preferred, it is envisioned that alternate configurations of the present invention may be adopted without deviating from the invention as portrayed.

The preferred embodiments are discussed hereafter.

Referring first to FIG. 6, a perspective view of a Posture Device of the present invention, generally indicated as 200, and an operator, generally indicated as 220, are shown.

The Posture Device 200 comprises of a Base Unit 240. The Base Unit comprises of a Guide 260 running largely longitudinally parallel to the longitudinal axis of the Base Unit. The Base Unit also has a Top End 280 as well as a Bottom End 300.

The Base Unit 240 supports the Posture Device 200 in a stable manner on a flat surface, such as a floor, so as to allow safe, stable, and effective use of the Device 200. The Guide 260 allows a Neck Support Unit 320 to connect to it in a sliding manner situated closest to the Top End 280. The Guide 260 allows a Mid back Support Unit 340 to connect to it in a sliding manner adjacent to the side of the Neck Support Unit 320 facing the Bottom End 300. The Guide 260 allows a Pelvic Support Unit 360 to connect to it in a sliding manner adjacent to side of the Mid back Support Unit 340 facing the Bottom End 300.

The Pelvic Support Unit 360 comprises of a Top Surface 380 that can be adjustably tilted, with the Top Surface planar angle of 22.5 degrees from the horizontal as an optimal angle.

It is contemplated that the Support Units 320, 340, and 360 rest on Base Unit 240 in so as to fully supports the total weight of Operator 220 in a stable manner.

Figure 1:
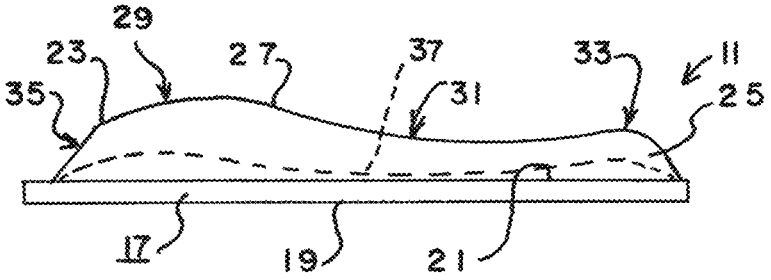
FIG 1 Prior Art
FIGS. 1 to 4 illustrates the illustrations of Prior Art as reference.
Figure 2:
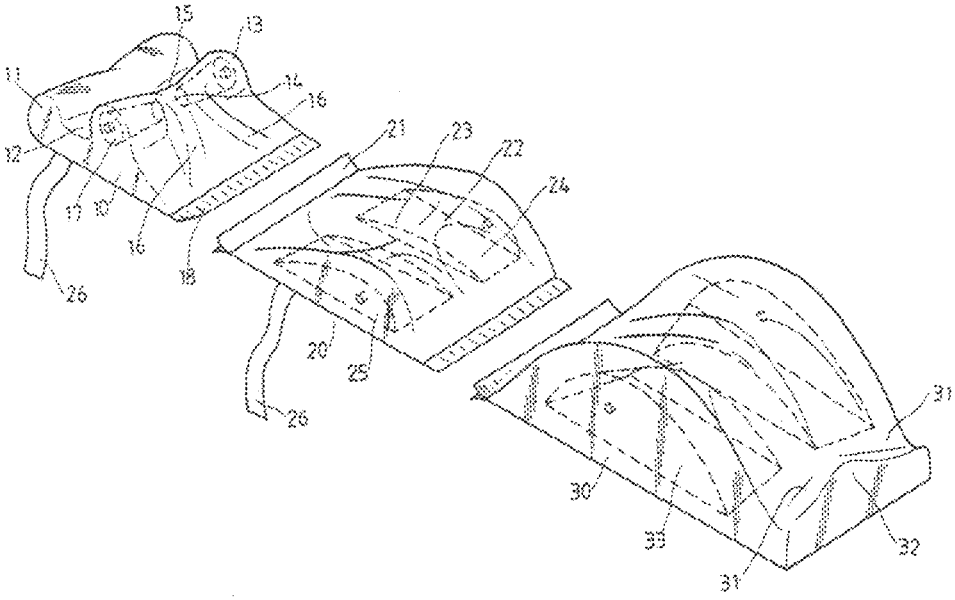
FIG 2 Prior Art
Figure 3:
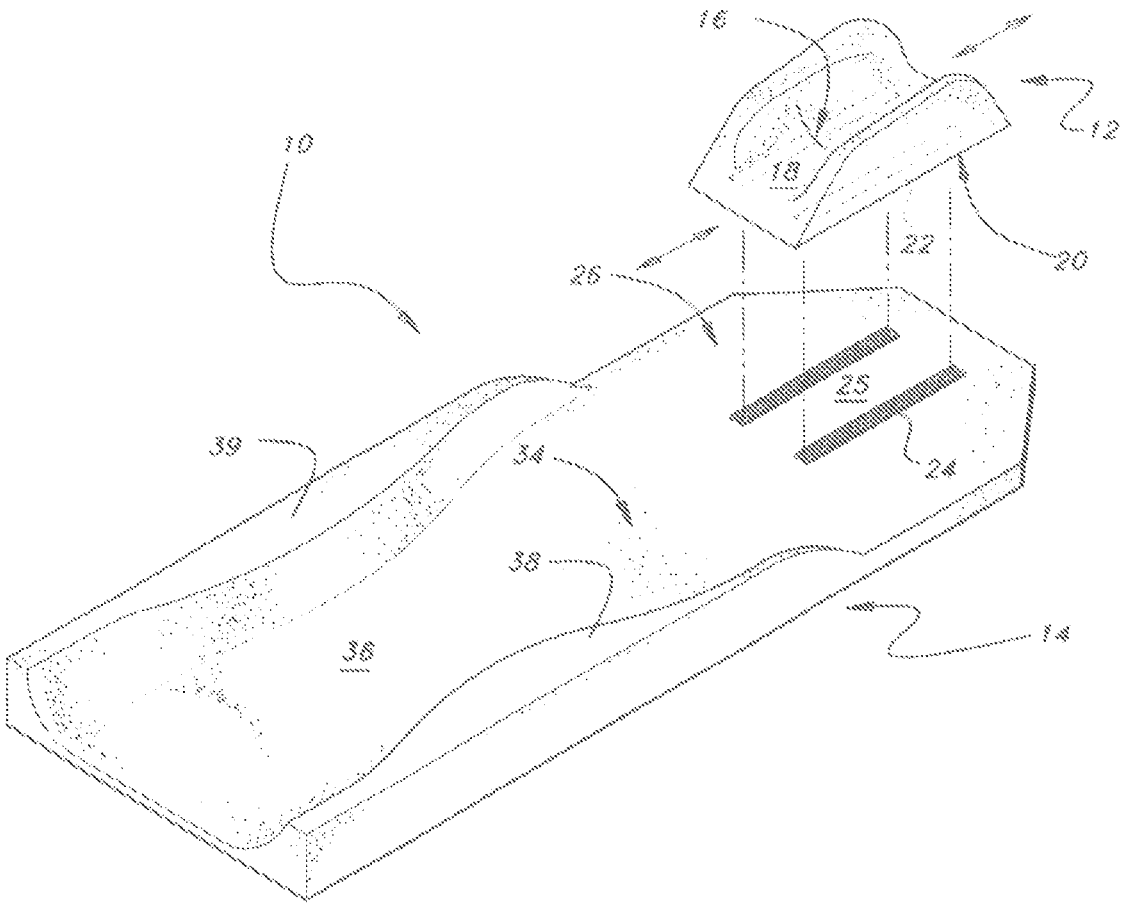
FIG 3 Prior Art
Figure 4:
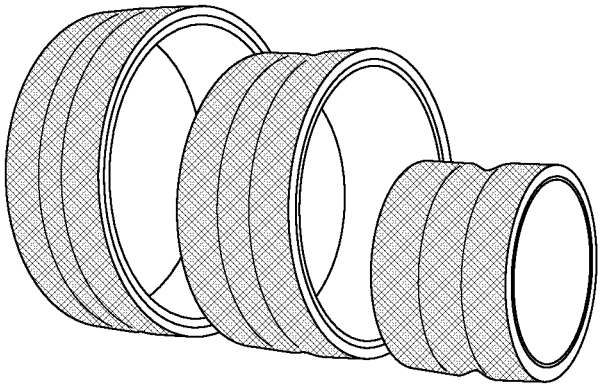
FIG 4 Prior Art
Figure 4:
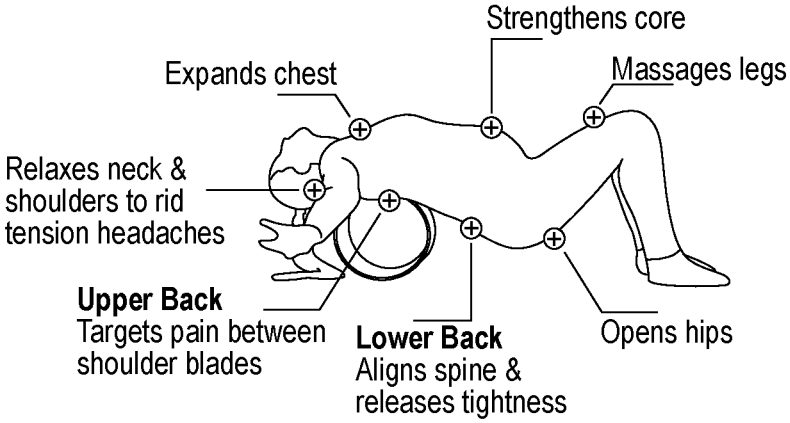
FIG 4 Prior Art
Figure 5:
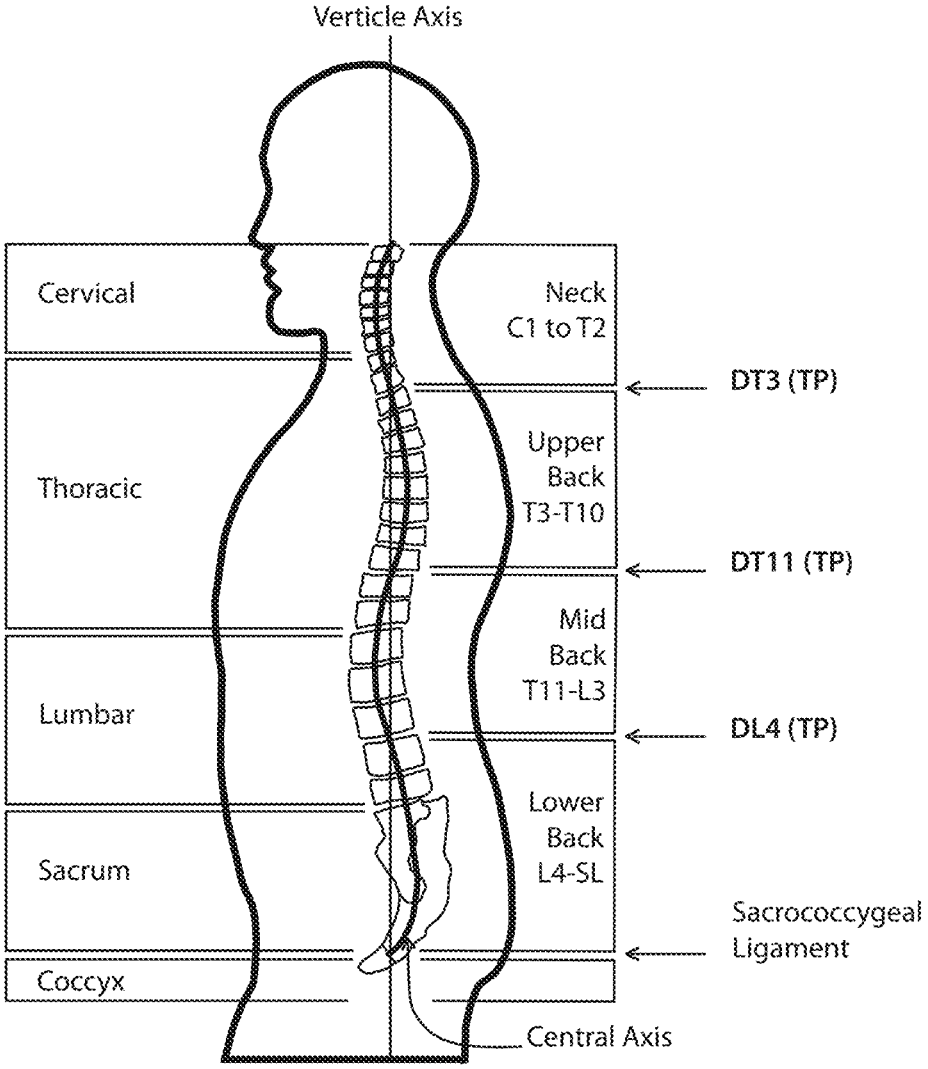
FIG. 5 illustrates a side view of the spinal vertebrae in a human anatomy

Referring to FIGS. 5 and 6, it is also contemplated that the Support Units 320, 340, 360 will each have a contour that fully supports their corresponding spinal section of an ideal posture. It is critical that each support is contoured, using a combination of convex and concave curves, so as to the fully support the Transition Points found in their respective spinal sections. These Transition Points is when a normally curved spine crosses over a vertical line, a line whose ends are defined by that connected the top vertebrae and to the last vertebrae.

Operation: Apparatus, FIG. 6.

In reference to FIG. 6, and although not required to fully function the device 200, Operator 220 will maximize the benefits from using the device 200 by making the following adjustments to fit the device 200 to somewhat conform to his ergonomics prior to operating it.

The adjustments to support units 320, 340, and 360 by sliding up and down base unit 240 along the guide 260 are preferred in the manner that the operator body is stable and suitably supported on the support units 320, 340, and 360. One desired outcome for these adjustments is so that the operator lies on the supports without incurring hot spots of pressure that would make such operation too painful to bear. However, some discomfort is preferred especially when it is caused by a spinal curvature that needs remediating, so long this pain is below the pain threshold no longer acceptable to the operator.

After adjusting the supports 320, 340, 360 to the above mentioned condition, the operator 220 then lies on top of these supports and remains there. The resulting reactive force from the supports into the operator works to rearrange the soft tissue and skeletal arrangement in a remediative way. Additionally, splay forces, both longitudinally and transversely to the length of the base, created by the operators weight onto these supports pushes the soft tissue and spinal vertebrae, further assisting remediation.

It is currently contemplated for this device 200 to allow the operator 220 to remediate his soft tissue and skeletal form while lying down on all sides, i.e. supine, facing down, and facing sideways. The supports 320, 340, and 360 can be rearranged on the base unit 240 in a manner that would support the curvature differences from lying down in these different orientations.

Additionally, the operator 220 can use increase the reactive and splay forces in a controlled manner. The operator 220 can lay weights directly on his body, or hold a bench press bar laden with weights across chest. The operator 220 can also increase or decrease the distances between the supports which would then increase or decrease the reactive and splay forces on his body. The operator can also adjust the tilt angle of the top surface 380 which would allow the operator to have his feet remove some of the reactive and splay forces as well.

Description—Alternative Embodiment FIG. 7-9

First Alternative Embodiment

In reference to FIG. 7, the device 200 has a Top End 280 and a Bottom End 300. The device 200 comprises of a Base unit 240 that has a First Support End 400 projecting from the Base Unit 240 near the Top End 280. This support end 400 can have longitudinal and/or transverse cutouts, hereby known as First Depression 420, to provide real estate relief for the nose and eye features. A Second Support end 440 emanates from the Base unit 240 in such a way that both support ends 400 and 440 form a Second Depression 460 in between them. A Third Support End 480 emanates from the Base Unit 240 in such a way that both support ends 440 and 480 form a Third Depression 500 in between them. A Fourth Support end 520 emanates from the Base unit 240 in such a way that both support ends 480 and 520 form a Fourth Depression 540 in between them. It is contemplated that the support ends will have the surface curvature similar to the main embodiment mentioned above necessary for adjusting the spinal column.

Operations:

FIG. 8—Supine Orientation: Operator 220 lies on the device 200 in a manner that the base unit 240 substantially embraces operator's spinal column. This would require that operator's cervical area to lie onto the Second Support End 440. Subsequently, the operator's lower back is supported by the Third Support End 480. And finally, the operator's knee joint area lies onto the Fourth Support end 520.

Upon reaching a suitable position lying on top of device 200, the operator 220 can apply a downward force to increase the reactive and splay forces imparted onto his back by applying weights directly onto his body, or holding them above his body (the weight device is not shown as it is a known art).

FIG. 9—Face down Orientation: Operator 220 lies on the device 200 in a manner that the base unit 240 substantially embraces the front side of the operator's while facing the unit. This would require that operator's face area to lie onto the First Support end 400. The eyes and nose features can fit in the First Depression 420 to protect them from distortion, discomfort, and injury during operation. Also, the face down operations would require that operator's chest area to lie onto the Second Support end 440. Subsequently, the operator's front pelvis area lies onto the Third Support end 480. And finally, the operator's lower thigh and knee joint area lies onto the Fourth Support end 520.

Upon reaching a suitable position lying on top of device 200, the operator 220 can apply a downward force to increase the reactive and splay forces imparted onto his front by applying weights directly onto his body, or holding them in his hands.

Second Alternative Embodiment

In reference to FIG. 10, the support ends 440, 480, and 520 have a pair of raised ridges 560A and 560B protruding higher than the top surface of the support ends. The raised ridges 560A&B are parallel to each other, and spaced apart so as to form a Fifth Depression 580 that can accommodate the spinuous processes of a human spine, but less than the normal width of the vertebra of a human spine as diagrammatically illustrated in FIG. 11. Spinous process is a bony projection off the posterior (back) of each vertebra. The raised ridges 560A and B can be integral with the support ends 440, 480, and 520. However, a removable version is when the raised ridges 560A&B to be made as an insertable piece into the support ends 440, 480, and 520 that now have cutouts 600A&B to allow the raised ridges to be inserted from beneath the support ends.

Operations:

The operation is simple for the integral raised ridges in that it is a repeat operation for the First Alternate Embodiment. However, the operator 220 lies on the raised ridges 560A&B so that his spinous process is substantially aligned between the ridge members, as illustrated in FIG. 11.

The operation of the insertable raised ridges is identical to the integral raised ridges except there is an added prepatory step. The insertable raised ridges 560A& B are passed through the cutouts 600A&B respectively from beneath the support ends 440, 480, and 520 before operator 220 continues to operate the device 200. When the operation does not require the raised ridges 560A and B, they are removed from the bottom of the supports ends 440, 480, and 520. Leveling insert 620 A, B, and C can be introduced between the supports and the raised ridges so as to vary the height of the raised ridge to the top surface of the support ends, even to the point the raised ridge is flushed or sub flushed to the top surface of the support ends.

Third Alternative Embodiment

In reference to FIG. 12, the device 200 is shown in the manner that has it operating with the operator 220 sitting up. The device 200 is used in conjunction with furniture such as with a chair. This upright use of the device 200 allows the operator to sit upright while enjoying substantially the same benefits of the device 200 as if in the horizontal position.

Also shown in FIG. 12, and referring to FIG. 5; the crest of the second support end 440 substantially coincides with the vertebrae C4; the crest of the third support end 480 substantially coincides with the vertebrae L1; and the crest of fourth support 520 is below the sacrcygeal of the operator 220. This results in an optimal distance between support ends; an example of dimensions between areas of the spine needing critical support are seen in FIG. 12 for a 29 inch spine.

Operations:

The device 200 is to be used in conjunction with a chair, in this case, the device 200 is attached to a chair using well known means such as a Velcro strap. It is also considered that the device 200 has adjustable and Locking Hinge 640 that connects the lower portion 660 to the upper portion 680. This hinge allows the upright portion of the device to adjust in relation to the lower portion so as to change and lock the angles between the upper and lower portion.

Fourth Alternative Embodiment

In reference to FIG. 13, the device 200 is shown in the manner that has a Fifth Support 700 supporting the foot portion of the operator 220 while lying face down or up on the device. This addition of the Fifth support 700 enhances the benefits the operator would receive from the First, Second, Third, and Fourth Supports (400, 440, 480, and 520 respectively) in that the Fifth support would provide forward and rearward encouragements to the body contour, allowing the muscular and skeletal positions for greater therapeutic benefits.

Operations:

The Fifth support 620 is operated in the same manner as with the First, Second, Third, and Fourth Supports (400, 440, 480, and 520 respectively); in that, the Fifth support 620 is moved up and down the length of the base unit 240 until it supports the operator 220 in a manner that anatomically provides the greatest benefit to the area it is in contact with the operator 220, and/or it enhances the benefits provided by the other supports mentioned above.

Fifth Alternative Embodiment

In reference to FIG. 14, the device 200 is shown as a One-Piece device that starts of as a flat contiguous mat. The illustration FIG. 14, for teaching purposes, focuses on ONE (1) support end (hereby called First Support End 400) and ONE (1) Raised Ridge (hereby called Raised Ridge 560B). However, both of these elements, although limited here for teaching purposes here, can be duplicated to give the full benefits as described in previous embodiments in this application and in no way be construed as the limits of this embodiment.

The device 200 is currently envisioned as One-Piece that is segmented both lengthwise—for the variable support end location—as well as width wise for a variable height Raised Ridges 560 A&B. As a result of this segmentation, the device 200 is inherently flexible that it can be rolled up like a yoga mat, allowing a compact and lightweight profile for easy storage and transportation.

Focusing on the flat part, the device 200 is currently contemplated to be made from a repeating group of segments joined contiguously back to back to each other. The First Group 720 comprises of a First Segment 740 and a Second Segment 760. In reference to FIG. 15 and more so on FIG. 16, the first segment 740 comprises of a Vertical side 780, a Bottom side 800, and a Slope side 820. The Slope side 840 has a High End 840 and a Low End 860. The second segment 740 is a mirror opposite of the First segment 720, resulting in the vertical sides 760 of both first segment 720 and second segment 740 facing adjacently to each other. These vertical sides 760 are then joined to each other by a First Flexible Membrane End 860 at the bottom of the vertical sides 760 of both segments 720 and 740. The First Flexible Membrane End 860 is of the properties that it allows the first segment 720 and second segment 740 to be configured in a manner that allows both segments 720 and 740 to fold in a way that brings their bottom sides 780 facing and adjacent to each other. This folded configuration turns the vertical sides 760 of the first 740 and second 760 segment into the supporting top surface curvature for first support end 400.

Since the device 200 is segmented in a contiguous manner, a Second Group 880—identical to the first group 720—is joined to the first group 720 by the low end 860 of second segment 760 of the first group 720 joined to the low end 860 of the first segment 740 of the second group 880. This makes the bottom side 800 of the first group 720 and of the second group 880 joined in a contiguous manner. Additionally, the properties of this joint is such that it allows the slope side 820 of the second segment 760 of first group 720, and the slope side of the first segment 740 of the second group 880 to come in contact with each other; this folding manner is a needed configuration as a building block for the first support end 400.

Shown in FIG. 14 are additional groups, identical to groups 720 and 880, added to lengthen the device 200 using the daisy chain joining of groups described above.

Additionally, the device 200 also can be segmented longitudinally (lengthwise) into a First Portion 900 and a Second Portion 920. This segmentation allows the device 200 to be configured so that the raised ridge 560B can be variable in height by bringing both portions 900 920 closer or further apart from each other.

In the raised ridge 560B configuration shown in FIG. 14, the device 200 is currently contemplated to have the first portion 900 joined contiguously to the second portion 920, maintaining the device 200 as One-Piece. The first portion 900 comprises of the daisy chaining of groups of segments 740 760 described above. It is envisioned that the second portion 920 is identical to first portion 900, with the identical segments positioned side by side in a matching side view way, i.e. the vertical sides 780 of the segments 740 760 match up between both first 900 and second portion 920. In reference to FIG. 17, View 'A' of FIG. 14, the sloped sides 820 of the first portion 900 and second portion 920 are then joined to each other by a Second Flexible Membrane End 940 at the slope side 820 of both identical segments 760 of each portion 900 920. This means segment 760 of first portion 900 is joined to segment 760 of second portion 920 by this second flexible membrane end 940.

Referring to FIGS. 15, 18, and 19, the Second Flexible Membrane End 940 bends in either downward to or upwards away from the bottom side 800 when the first portion 900 and second portion 920 are urged closer to or away from each other in a variable manner. An Upward Bend 980 varies the height of the Raised Ridge 560B, whereas the Downward Bend 1000 is needed for clearance. This clearance is so that the connecting segments from adjacent groups (e.g. segment 760 from group 720, segment 740 from group 880) fold onto themselves so that their slope sides 820 rest on each other. This folding makes the groups of segments form the architecture of a Roman Stone Bridge (featuring wedge shape arch stones of same shape and size making up the curvature of the bridge) where each group is supporting each other structurally in a curved manner that makes up the first support end 400.

FIG. 15 is a magnified view of a local area in FIG. 14 that is further enhanced with cutout sections of raised ridge 560B in both segments 740 and 760. Using FIG. 15 as a primary figure with supporting figures FIG. 17, 18, 19, the vertical sides 780 of identical segments (either first or second segments) of each portion are joined to each other by a Third Flexible Membrane End 960. This membrane end 960 becomes portions of the raised ridge 560B where the device 200 is configured as the first support end 400. This membrane end 960 has the ability to bend in an opposing direction. The membrane end 960 bends either Away from Segment 1020 or Into Segment 1040. This dual direction bending is needed so that the membrane end 960 for both segments 740 & 760 can bend into segment 104 or they can also embrace each other in a conjugal way from having one membrane end 960 bend away from segment 1020 (illustration shows this condition for the second segment 760) while the other membrane end 960 bends into segment 1040 (illustration shows this condition for the first segment 740). This way, either one of the membrane end 960 configurations mentioned above can be selected so that there is not a membrane-to-membrane 960 interference from either segments 740 &760 that would preclude both segments 740 & 760 from resting close to each other as possible in order for the bottom sides 800 of both segments 740 &760 to be joined together in a flat way, allowing the base unit 240 to lay flat.

It is contemplated that the above one piece embodiment can be injection molded as one contiguous device 200. Another manufacturing variation that takes advantage of the repeating nature of segments is the device 200 comprises of a several groups (first group 720, second group 740 are only called out here for teaching reasons), with each group identical to each other in that they all contain the first segment 740 and second segment 760, and that they are linked together in a interlocking and hinge-able manner preferably at the low end 860 side of each group. The interlocking and hinge-able manner is not illustrated here as it is a known art.

Operations:

Referring to FIGS. 14, 20, and 21, the device 200 is in a flat position lying on a ground as seen in the first and second group 720 & 800. In order to configure the device 200 to feature a support end (e.g. first support end 400), segments 740& 760 within each group are folded so that their vertical sides 780 are exposed to come in contact with operator 220. This folding of segments onto each other is repeated to the adjacent groups so that the groups are closely embracing each other to produce a tight configuration 1060 (see FIG. 20), or they can be loosely embracing each other each other in loose configuration 1080 (see FIG. 21). This way, the former produces a higher and tighter radius feature for the support end 400 than the latter. It is contemplated that this radius is maintained by the friction force produced by the weight of the operator 220 acting down on the bottom side 800 of all flat groups onto a ground. In the event the bottom side 800 and this ground does not produce enough friction to maintain the shape of the support 400, it is contemplated that an additional adjustable strap 1100 secures the distance between—and connects to each other—the outer most groups within the support 400. The strap 1100 is adjustable so that it is longer for the loose configuration 1080 than the tight configuration 1060.

This operation is repeated to produce a second support end 440 of adjustable height and radius, to be located away from first support 400 along the length of the device 200. Also, the distance between the centers of both support ends 400 &440 can be varied simply by varying where the second support end 440 begins from the first support end 400. This results in a varying first depression 420 length, a length defined as the varying distance between where the support ends 400 & 440 begin from each other. The second support 440 is not illustrated but is presumed to be identical in teachings as, and further illustratively identical to, the first support end 400.

The device 200 can be configured along the length of base unit 240 so that the location of First Support End 400 can be tailored to fit into the curvature of the operator 220 while lying in any preferred orientation on the device 200. Aside from this curvature fitting, the device 200 also allows the ability to further tune the first support end 400 location, further increasing the ability to provide greater but selected pressure to the body contour for greater therapeutic benefits.

Referring to FIG. 16, in the event the segments 740 and 760 connection within the group, as well the groups to group connections, need to be unitized to act as one combined unit—especially in the loose configuration where the adjustable strap 1100 may need not be sufficient—the segments intra and inter group can interlock to each other with a Male Interlock 1200 and a Female Interlock 1300. Both these interlocking features 1200 & 1300 are integral to the segments 740&760 on the bottom and slope side 800&820. This allows the segments 740& 760 to lock to each other within a group, and groups (such as groups 720 and 880) to interlock to each other; both connections unitize segments together when configured as a support end.

With the above mentioned operations, the amount of supports, the distance between supports, the radius and height of each support; all these can be varied so as to provide the support geometry according to the operator's 220 choosing.

The device 200 has the option of a Raised Ridge 560A&B that can vary in height. Referring to FIGS. 15, 18, and 19, first portion 900 and second portion 920 can be brought closer together to raise the ridge 560B height. In the converse, the first portion 90 and second portion 920 can be separated from each other to lower the ridge 560B height until there is no ridge but a flat membrane surface 940 (FIG. 17). This allows the operator to vary the ridge height according to her choosing.

Referring to FIGS. 15 and 18, it is contemplated that the ridge 560 radius and height are maintained by the friction force produced by the weight of the operator 220 acting to push bottom side 800 of all non-folding groups onto a ground. In the event the bottom side 800 and this ground does not produce enough friction to maintain the shape of the ridge 560, it is contemplated in FIG. 16 that an additional locking mechanism—produced either by a male straps 1400 and female straps 1500 (both integral to membrane end 940) that locks together in an adjustable manner or by just an additional adjustable strap 1100 (FIG. 17) as mentioned above—secures the distance between the portions 900 and 920 to each other. The interlocking between male strap 1400 and female strap 1500, and strap 1100, are adjustable so that either one can vary in locking lengths needed for a looser radius ridge in FIG. 19 as well as for the tighter radius ridge in FIG. 18.

Illustrations of the Subject Technology as Clauses:

Some example aspects of the subject technology may be represented as clauses. These clauses are examples of the subject technology, and do not limit the subject technology.

1. An Apparatus comprising of a base unit to be used in conjunction with a human body, the base unit having a first end and a second end, An Apparatus further comprising of at least a first support end and at least a first support unit; the at least first support end located at the first end, the at least first support unit slidably and lockably located longitudinally on the base unit away from the at least first support end to form a first intermediary gap, the at least first support unit comprising of a contoured side to largely receive and support the curvature of the human body.
2. The Apparatus of clause 1 further comprising an at least second support unit, and an at least third support unit; the at least second support unit slidably and lockably located longitudinally on the base unit away from the at least first support unit to form a second intermediary gap, and the at least third support unit slidably and lockably located longitudinally on the base unit located away from the at least second support unit to form a third intermediary gap.
3. The Apparatus of clause 2 wherein the first support end is contoured to largely receive and support the cervical area of a human spine, the first support unit is contoured to largely receive and support the lumbar area of said spine, the second support unit is contoured to largely receive and support the pelvis area of said spine, and the third support end is contoured to largely receive and support the ankle area.
4. The Apparatus of clause 3 where the first, second, and third support units comprise of a first transition point surface, a second transition point surface, and a third transition point surface respectively, wherein these transition point surfaces project from the base in a manner where they can be substantially connected to each other in a straight line; wherein the human spine comprising of a first, of a second, and of a third transition point that correspond to the location on the spine where the spine inverts from a concave to a convex curvature in the sequence from the cervical and ending at the sacrum area; whereby the first support unit, the second support unit, and the third support unit can be adjusted so that the first, second, and third transition points are supported in a manner that substantially aligns them in a straight line.
5. The Apparatus of clause 4 where the first support end further comprising a first recess and a second recess, the first recess end running longitudinally substantially down the middle of the first support unit, the second recess running traverse to the first recess; whereby both first and second recess are substantially located on the first support unit to provide relief for the human eyes, nose, and mouth.
6. The Apparatus of clause 1 where the contoured side of the at least first support unit optionally comprises of a first ridge support end and a second ridge support end that both project normally from the contoured side, the first ridge support end and the second ridge support end are positioned apart from each other at a distance no wider than the normal thickness of a spinous process of a human spine but less than the normal width of the spine, the longitudinally length of the first ridge support end and of the second ridge support end run substantially parallel to the longitudinal length of the base unit.

7. The Apparatus of clause 6 optionally comprising of a first insert assembly, the first insert assembly comprising of a first ridge support and a second ridge support coupled to each other, the contoured side optionally comprising of a first aperture and a second aperture, the first insert assembly slidably engaging with the at least first support unit in a selectable manner with the first ridge support passing through the first aperture and the second ridge support passing through the second aperture, whereby the amount of the first ridge support end and the second ridge support end protruding beyond the contoured side is adjustable in a locking manner.
8. The Apparatus of clause 7 wherein the amount of the first ridge support end and the second ridge support end protruding beyond the contoured side optionally comprises of a predetermined height shim intermediary between the at least first support unit and the first insert assembly.
9. A base unit to be used in conjunction with a human body, comprising of a plurality of support ends, the plurality of support ends comprising of an at least a first support end; the at least first support end located longitudinally along the base unit, the at least first support end comprising of a contoured side to largely receive and support the curvature of the human body, the base unit is segmented into a plurality of mirror identical units coupled to each other in a flexibly connecting manner, the plurality of mirror identical units comprising of at least a first unit and a second unit, the first unit comprising of a first segment and a second segment, the first segment comprising of a high end and a low end, the second segment is identical to the first segment but oriented in a mirror opposite manner to the first segment, the first segment and the second segment are flexibly coupled to each other at each other's high ends, the second unit is identical to the first unit, the low end of the first segment of the second unit is flexibly coupled to the low end of the second segment of the first unit; whereby the base unit can be configured so that the first support end can be variably located along the longitudinal length of the base unit, whereby the protrusion height and the radius of the first support end are both variably and adjustable in a selectable manner.
10. The Apparatus of clause 9 further comprising of a first portion and a second portion, the second portion being mirror identical to the first portion, the first segment comprising of a slope side and a vertical side, the first segment of the first portion is flexibly coupled to the first segment of the second portion at both their slope sides by a first couple, the first segment of the first portion flexibly coupled to the first segment of the second portion at both their vertical sides by a second couple; wherein the apparatus further comprising a third ridge support comprising of the first couple and the second couple in the proximity of the at least first support end; whereby the proximity distance between the first portion and the second portion is selectably adjusted so that the first couple and the second couple buckle in a varying and locking manner, whereby the height of the third ridge support running substantially longitudinal along both the first support end and the base unit can be varied by the proximity distance.
11. The Apparatus of clause 10 further comprising a third portion, the third portion being mirror identical to the second portion, the first segment comprising of a slope side and a vertical side, the first segment of the second portion is flexibly coupled to the first segment of the third portion at both their slope sides by a third couple, the first segment of the second portion flexibly coupled to the first segment of the third portion at both their vertical sides by a fourth couple; wherein the apparatus further comprising a fourth ridge support comprising of the third couple and the fourth couple in the proximity of the at least first support end; whereby the proximity distance between the second portion and the third portion is selectably adjusted so that the third couple and the fourth couple buckle in a varying and locking manner, whereby the height of the fourth ridge support running substantially longitudinal along both the first support end and the base unit can be varied by the proximity distance between the second portion and third portion.
12. The Apparatus of clause 10 wherein the first couple between the first and second portion further comprise of a first leg and a second leg projecting substantially normal to the first couple, the first leg and the second leg selectively and adjustably lock to each other in a locking manner, whereby the proximity distance between the first and the second portion is varied in an selectably locking manner.
13. The Apparatus of clause 10 further comprising a first adjustable strap having a first end and a second end, the first end is lockably attached to the first portion, the second end is lockably attached to the second portion, wherein the proximity distance between the first and second portion is adjusted in a locking manner by changing the length of the first adjustable strap.
14. The Apparatus of clause 9 wherein the plurality of units further comprising of an at least third unit and a second adjustable strap, the third unit is identical to the second unit, the low side of the first segment of the third unit is flexibly connected to the low side of the second segment of the second unit by a fifth couple, the second adjustable strap having a first end and a second end, the first end is lockably attached to the at least first unit, the second end is lockably attached to the at least third unit located longitudinally away from the at least first unit, wherein the proximity distance between the at least first unit and the at least third unit is adjustable in a locking manner by changing the length of the second adjustable strap, wherein the first support end is configured to comprise of the at least first unit and the at least third unit; whereby the radius and height of the first support end is adjustable in a removably locking manner by adjusting the length of the second adjustable strap.
15. The Apparatus of clause 14 wherein the second adjustable strap comprises of an oscillating device that lengthens and shortens the proximity distance between first unit and the third unit in an oscillating manner.
16. The Apparatus of clause 13 wherein the first adjustable strap comprises of an oscillating device that lengthens and shortens the proximity between the first portion and the second portion in an oscillating manner.
17. An Apparatus comprising a base unit to be used in conjunction with a human body, comprising of a plurality of support ends, the plurality of support ends comprising of an at least a first support end; the at least first support end located longitudinally along the base unit, the at least first support end comprising a contoured side to largely receive and support the curvature of the human body, the base unit is further segmented into a first longitudinal portion and a second longitudinal portion that are pivotally connected to each other in an adjustably locking manner between the angles of 60 to 180 degrees, the first longitudinal portion further comprising of an at least a second support unit located longitudinally away from the at least first support end in an adjustable and locking manner to form a first intermediary gap, the second longitudinal portion further comprising of an at least third support unit; whereby the apparatus can be optionally used as a stand-alone chair or in conjunction with a furniture such as a chair by means of securing device to the furniture with locking loop straps.

CONCLUSIONS, RAMIFICATIONS, AND SCOPE FOR DEVICE

The First Portion 900 and Second Portion 920 can be connected to each other in a dynamic and oscillating way with both portions connected to an oscillating device, such as a motor and a cam arm. This way, the distance between portions shortens and lengthens in an alternating way, varying the height and radius of the Raised Ridge 560A&B in also an alternating way. This alternation of ridge shape then produces an alternation of pressure onto the user 220. This alternating pressure is akin to the benefits found in the known art of electronic controlled electric Shiatsu chairs. This alternation promotes blood flow, helps break up any muscles knots, and provides a kneading of the soft tissue area that promotes relaxation. In essence, the Fifth Embodiment provides the means of transforming an oscillation motion, such as a motor and cam arm, into an oscillating massage therapy table or chair.

Additionally, it is anticipated that the Fifth Embodiment can be an advance Yoga Mat, where the mat can be configured to support the user through the varying Yoga poses. The supports can be configured so that the user experience greater strengthening forces or even mild traction in her joints or spinal vertebrae during such pose. Aside from Yoga poses, the mat can be configured with a negative angle, much like zero-gravity chairs which people hang upside down from. This reduced gravity force relieves the user of forces in the joints, and helps lengthens muscles.

Additionally, it is anticipated that the Fifth Embodiment can be an ergonomic furniture that can be used in a wide variety of applications, such as on the beach all the way to a Chair. However, as in the beach application, the adjustable strap 1100 is recommended to maintain the preferred configuration since the sand on the beach may not be sufficiently stable enough as a shape support. As for the chair application, the user can configure the embodiment to provide the necessary supports for maximum ergonomic benefits. As with the beach application, the adjustable strap 1100 is recommended as well as the chair may not have sufficient friction with the embodiment to maintain the preferred shape.

Additionally, it is anticipated that the embodiments here can incorporated into existing art. In one such case, the embodiments here can be inserted into a depression area found in a massage table. It can be incorporated as a center piece, much like the center piece in a butterfly leaf table. It is considered the two halves of a table separating to either drop in or raise up this middle section containing one of the embodiments. And when the embodiment is no longer needed, this middle section containing the embodiment can be removed or lowered into the table, and the two halves couple together, hiding the embodiment.

Although the embodiments show connections connecting non moving members together, these members can be coupled together by other methods such as welding, epoxy gluing, wrapping, etc. This eliminates the plurality of connections themselves, reducing the assembly complexity (less elements), reducing the weight, as well as cost. Additionally a connection can be made integral to a member communicating with it in a static way when coupled together. Additionally, an intermediate piece can be wholly eliminated if a member can be bent into the same shape as outlined by an assembly of members and connections. One such possibility is to select a combination of cross sections, wall thickness, material thickness, and shape that would allow . . . .

While the above description contains many specificities, these should not be construed as limitations on the scope of any embodiments, but as illustrations of various embodiments thereof. Many other ramifications and variations are possible with the teachings of the various embodiments.

Accordingly, the scope should not be determined by the embodiments illustrated, but by the appended claims and their legal equivalents.

The invention claimed is:

1. A method of treating a patient having a head and a vertebral column comprising:

providing a device comprising a base unit having a longitudinal axis along first and second ends, and having a first elevated support end having a convex topside, and positioned at the first end, the device further comprising a first support unit having a convex topside and configured to be slidable and releasably lockable along the longitudinal axis of the base unit both towards and away from the first elevated support end so as to form an intermediary gap between the first support unit and the first elevated support end, and further comprising a second support unit having a convex topside and configured to be slidable and releasably lockable along the longitudinal axis both towards and away from the first support unit so as to be capable of forming an intermediary gap between the second support unit and the first support unit; and positioning a patient on the device a supine position, wherein, the convex topside of the first support unit supports the midpoint between the T11 and L3 vertebrae and the convex topside of the first elevated support end supports the midpoint between C1 and T2 vertebrae such that the chest of the patient is unsupported, and wherein the convex topside of the second support unit supports the upper thighs when the patient is in the supine position.

2. The method of claim 1, wherein the device further comprises a third support unit having a convex topside and positioned along the longitudinal axis so as to have an intermediary gap between the second support unit; and wherein the convex topside of the third support unit supports the legs in the area above the ankles.

3. The method of claim 1, wherein the device comprises a first ridge and a second ridge that both project upward and run substantially parallel to the longitudinal axis of the base unit and are longitudinally aligned with the first support unit.

4. The method of claim 3, wherein the first and second ridges protrude upward from the topside of the first support unit.

5. The method of claim 3, wherein the first and second ridges do not protrude upward past the topside of the first support unit.

6. The method of claim 3, wherein the device further comprises a shim configured to adjust the amount of the first and second ridge that the patient feels, wherein the shim is positioned on top of the first and second ridges and below the first support unit.

7. A method of treating a patient having a head and a vertebral column comprising:

providing a device comprising a base unit having a longitudinal axis along first and second ends, and having a first elevated support end having a convex topside, and positioned at the first end, the device further comprising a first support unit having a convex topside and configured to be slidable and releasably lockable along the longitudinal axis of the base unit both towards and away from the first elevated support end so as to form an intermediary gap between the first support unit and the first elevated support end, and further comprising a second support unit having a convex topside and configured to be slidable and releasably lockable along the longitudinal axis both towards and away from the first support unit so as to be capable of forming an intermediary gap between the second support unit and the first support unit; and positioning a patient on the device in a face-down position, wherein, the convex topside of the first support unit supports the midpoint between the T3 and T10 vertebrae and the convex topside of the first elevated support end supports the patient's face, and wherein the convex topside of the second support unit supports the midpoint between L4 vertebrae and the sacrococcygeal ligament (SL).

8. The method of claim 7, wherein the device further comprises a third support unit having a convex topside and positioned along the longitudinal axis so as to have an intermediary gap between the second support unit; and wherein the convex topside of the third support unit supports the legs in the area below the knee caps.

9. The method of claim 7, wherein the first support end further comprises a recess configured to receive the patient's nose when positioned in a face-down orientation on the device.

10. The method of claim 7, wherein the device comprises a first ridge and a second ridge that both project upward and run substantially parallel to the longitudinal axis of the base unit and are longitudinally aligned with the first support unit.

11. The method of claim 10, wherein the first and second ridges protrude upward from the topside of the first support unit.

12. The method of claim 10, wherein the first and second ridges do not protrude upward past the topside of the first support unit.

13. The method of claim 10, wherein the device further comprises a shim configured to adjust the amount of the first and second ridge that the patient feels, wherein the shim is positioned on top of the first and second ridges and below the first support unit.

14. A method of treating a patient having a head and a vertebral column comprising:

providing a device comprising a base unit segmented into a first portion and a second portion that are pivotally connected to each other in an adjustably locking manner such that both first and second portions are configured to adjust from 180 degrees with respect to each other to 90 degrees with respect to each other, wherein the first portion comprises a first elevated support end and a first support unit having a convex topside and configured to be slidable and releasably lockable along the first portion both towards and away from the first elevated support end so as to form an intermediary gap between the first support unit and the first elevated support end;

positioning a patient on the device in a sitting position such that their legs are parallel with the second portion, and their back is parallel with the first portion, wherein, the convex topside of the first support unit supports the midpoint between T11-L3 vertebrae.

15. The method of claim 14, wherein the first and second portions are configured to be adjustably locked within a range of 180 to 60 degrees.

16. The method of claim 14, wherein the first and second portions are perpendicular to each other.

17. The method of claim 14, wherein the second portion comprises a second elevated support that supports the underside of the patient's thighs.

18. A base unit to be used in conjunction with a human body, comprising a first support end located longitudinally along the base unit, the first support end comprising a contoured side having a protrusion height and a radius to receive and support the neck and shoulders from C1 to T2, the base unit is segmented into first and second units that are mirror images of each other and coupled to each other in a flexibly connecting manner, the first unit comprising a first and second segment, the first segment comprising a high end and a low end, the second segment is identical to the first segment but oriented in a mirror opposite manner to the first segment, the first segment and the second segment are flexibly coupled to each other at each other's high ends, the second unit is identical to the first unit, the low end of the first segment of the second unit is flexibly coupled to the low end of the second segment of the first unit; whereby the base unit is configured to allow the first support end to be variably located along the longitudinal length of the base unit, whereby the protrusion height and the radius of the first support end are both variably adjustable.

19. The base unit of claim 18 further comprising a first portion and a second portion, the second portion being mirror identical to the first portion, and each having first and second segments, wherein the first segment of both the first and second portion comprises a slope side and a vertical side, the first segment of the first portion is flexibly coupled to the first segment of the second portion at both their slope sides by a first couple, the first segment of the first portion flexibly coupled to the first segment of the second portion at both their vertical sides by a second couple; wherein the device further comprises a ridge support comprising the first couple and the second couple in the proximity of the first support end; whereby the proximity distance between the first portion and the second portion is adjustable so that the first couple and the second couple buckle in a varying and locking manner, whereby the height of the ridge support runs substantially longitudinal along both the first support end and the base unit and is configured to be varied by the proximity distance.

20. The base unit of claim 19 further comprising a third portion, the third portion being a mirror image of the second portion and having a first and second segment, the first segment of the third portion comprises a slope side and a vertical side, the first segment of the second portion is flexibly coupled to the first segment of the third portion at both their slope sides by a third couple, the first segment of the second portion flexibly coupled to the first segment of the third portion at both their vertical sides by a fourth couple; wherein the device further comprising a second ridge support comprising of the third couple and the fourth couple in the proximity of the first support end; whereby the proximity distance between the second portion and the third portion is adjustable so that the third couple and the fourth couple buckle in a varying and locking manner, whereby the height of the second ridge support runs substantially longitudinal along both the first support end and the base unit and is configured to be varied by the proximity distance between the second portion and third portion.

21. The base unit of claim 19 wherein the first couple between the first and second portion further comprise of a first leg and a second leg projecting substantially normal to the first couple, the first leg and the second leg selectively and adjustably lock to each other in a locking manner, whereby the proximity distance between the first and the second portion is varied in a selectably locking manner.

22. The base unit of claim 21 wherein the plurality of units comprises a first adjustable strap having a first end and a second end, the first end is lockably attached to the first portion, the second end is lockably attached to the second portion, wherein the proximity distance between the first and second portion is adjusted in a locking manner by changing the length of the first adjustable strap, and wherein the device comprises a second adjustable strap, the third unit is identical to the second unit, the low side of the first segment of the third unit is flexibly connected to the low side of the second segment of the second unit by a fifth couple, the second adjustable strap having a first end and a second end, the first end is lockably attached to the at least first unit, the second end is lockably attached to the at least third unit located longitudinally away from the at least first unit, wherein the proximity distance between the at least first unit and the at least third unit is adjustable in a locking manner by changing the length of the second adjustable strap, wherein the first support end is configured to comprise of the at least first unit and the at least third unit; whereby the radius and height of the first support end is adjustable in a removably locking manner by adjusting the length of the second adjustable strap.

23. The base unit of claim 22 wherein the second adjustable strap comprises an oscillating device that lengthens and shortens the proximity distance between first unit and the third unit in an oscillating manner.

24. The base unit of claim 19 further comprising a first adjustable strap having a first end and a second end, the first end is lockably attached to the first portion, the second end is lockably attached to the second portion, wherein the proximity distance between the first and second portion is adjusted in a locking manner by changing the length of the first adjustable strap.

25. The base unit of claim 24 wherein the first adjustable strap is configured to oscillate to lengthen and shorten the proximity between the first portion and the second portion.

* * * * *